US005235939A

United States Patent [19]

Levin et al.

[11] Patent Number: 5,235,939

[45] Date of Patent: Aug. 17, 1993

[54] AUTOMOTIVE ENGINE TORSIONAL PULSE ENHANCER

[75] Inventors: Michael B. Levin, Birmingham; Julian A. Lorusso, Grosse Ile; Peter S. Szpak, Ann Arbor, all of Mich.

[73] Assignee: Ford Motor Company, Dearborn, Mich.

[21] Appl. No.: 971,656

[22] Filed: Nov. 5, 1992

[51] Int. Cl.[5] ..... F01L 1/02

[52] U.S. Cl. ..... 123/90.15; 123/90.31

[58] Field of Search ..... 123/90.15, 90.17, 90.27, 123/90.31, 90.6; 74/767, 769

[56] References Cited

U.S. PATENT DOCUMENTS

| | | | |
|---|---|---|---|
| 3,314,408 | 4/1967 | Fenton | 123/182.1 |
| 4,723,517 | 2/1988 | Frost | 123/90.31 |
| 4,754,727 | 7/1988 | Hampton | 123/90.31 |
| 4,771,742 | 9/1988 | Nelson et al. | 123/90.17 |
| 4,790,271 | 12/1988 | Onda | 123/90.17 |
| 4,794,893 | 1/1989 | Masuda et al. | 123/90.17 |
| 4,844,023 | 7/1989 | Konno et al. | 123/90.17 |
| 4,917,056 | 4/1990 | Yagi et al. | 123/90.16 |
| 4,934,348 | 6/1990 | Yagi et al. | 123/90.16 |
| 4,942,854 | 7/1990 | Shirai et al. | 123/90.17 |
| 5,040,500 | 8/1991 | Reece | 123/90.27 |
| 5,107,805 | 4/1992 | Butterfield et al. | 123/90.17 |

*Primary Examiner*—E. Rollins Cross
*Assistant Examiner*—Weilun Lo
*Attorney, Agent, or Firm*—Jerome R. Drouillard; Roger L. May

[57] ABSTRACT

Several concepts/methods and apparatuses are described and illustrated for enhancing/supplementing the natural bidirectional torsional pulses produced by an engine during its operation for use as an actuating force, for example, in a self-energizing engine phaseshifter; one method consisting of adding additional cam-lobe spring pairs providing the desired retarding or advancing torque impulses; or, selectively increasing the loads for the valve train springs by providing stiffer springs and fewer or greater coils or changing the weight of the spring or, using coaxial camshafts with independent phaseshifter mechanism to permit mounting of selected ones of the cam/spring pairs on one shaft with the remaining on the other shaft, in accordance with the desired net positive/negative producing torque pulses produced by the respective pairs

3 Claims, 4 Drawing Sheets

5.0L V8

DEG 5.0L V8 PRIOR ART

CAMDEG * 10E 2

5.0L V8 WITH ADDITIONAL SPRINGS (4.6L4V)

AUTOMOTIVE ENGINE TORSIONAL PULSE ENHANCER

FIELD OF THE INVENTION

This invention relates in general to an automotive type engine, and more particularly to the enhancement of the inherent bidirectional torque pulses in the valve train produced during operation of the engine.

BACKGROUND OF THE INVENTION

Self-energizing phaseshifters, which utilize the inherent bidirectional torque pulses in the valve train as the source of energy to shift the camshaft phase relationship relative to the engine crank rotation been proposed. For example U.S. Ser. No. 620,517, now U.S. Pat. No. 5,121,717, and U.S. Ser. No. 695,162, now U.S. Pat. No. 5,117,784, Internal Combustion Engine Camshaft Phaseshift Control Systems, and U.S. Ser. No. 856,268, now U.S. Pat. No. 5,165,368, Internal Combustion Engine With Variable Compression Ratio, all assigned to the Assignee of this invention, show devices for modular varying of the timing of the camshaft relative to the crankshaft, thus varying the timing of the engine valve actuation during engine operation.

This is accomplished through a low power consumption technique of self-actuating phaseshift wherein the overall engine performance is improved. Hydraulic control circuits control the onset and rate of phase change in the camshaft by controlling the oil flow between two oil volumes which are radially compressed to transfer motion from the engine to the camshaft.

These devices use the reaction torque pulses, induced by the compression and decompression of the engine valve return springs, as the energy for accomplishing the fluid flow between cavities and the resultant phaseshifting, which allows each system to be self-actuating with low power consumption, since no external hydraulic power is necessary to rotate the coupling between the camshaft and crankshaft.

In U.S. Ser. No. 856,272 now U.S. Pat. No. 5,163,386, Stroke/Clearance Volume Engine, also assigned to the Assignee of this invention, the reciprocating motion of the piston and rotation of the connecting rod produces auxiliary torque impulses acting first in one direction and then in the other as a function of the position of the piston. These torque pulses are used to cause a phaseshifting of the engine timing events to enhance fuel economy and reduce emissions, and for other reasons.

When the valve spring is compressed during opening of the valve, the rotation of the camshaft exerts a resistance to rotation of the crankshaft and therefore a positive torque is required to turn the camshaft. On the other hand, when the valve is being closed by the spring, the camshaft in effect is attempting to rotate ahead of the crankshaft, and a negative torque felt by the crankshaft develops to counteract this advancing torque of the camshaft.

In each of the above cases, it is important that the bidirectional torque pulses be approximately equal or symmetrical so that the forces applied in opposite directions to properly operate the phaseshifter will provide the desired phaseshifting. In some engines, the negative and positive torque pulses are not equal and there may be a substantial difference between them. These engines would not be suitable for use with the phaseshifters described above as self-energizing phaseshifters. In these engine installations, the bidirectional torque impulses may either cancel one another or are too weak to be effective as a phaseshifting force.

This lack of bidirectional torque pulses may be the result of two factors: 1) the manner in which torque reversals from individual cam lobes combine tends to cancel rather than enhance torque reversals due to the engine firing frequencies; and 2) negative torque swings as applied to the crankshaft, although adequate on their own to advance the phaseshifting mechanism, are removed due to positive torque on the crankshaft added due to bearing friction and/or accessory torque drag.

Stated another way, the greater the number of cams located on the camshaft, the denser the torque pulses become, i.e., the closer to one another they become. The entire camshaft experiences pulses originating in one direction from say one cylinder, whereas at the same time another cylinder is beginning to offset it, until it reaches a point where the phaseshifter is unable to recognize the origin, magnitude, or direction of the pulses, so that basically it loses the ability or speed with which changes can be made. The greater the torque pulse, the quicker the response and the quicker the phaseshift can be made.

Whatever the reason, a method and apparatus of enhancing the bidirectional torque pulses in one direction or the other would be needed to cause the self-energizing phaseshifter to be feasible. This invention provides such a bidirectional torque pulse enhancer concept.

DESCRIPTION OF THE PRIOR ART

The prior art shows various mechanisms for varying engine timing events, such as movable cams, rotatable cams, extra rocker arms cooperating with extra cams, etc.; but none teaches, nor is it inherent in any, to use means to enhance the natural torsional impulses of an engine valve train for use as an actuating force, such as, for example, in a self-energizing phaseshifter.

U.S. Pat. No. 4,844,023 to Konno et al. describes an automotive type valve operating mechanism that includes various embodiments of a drive rocker arm and a free rocker arm interconnected at times to be driven by a high-speed cam, for example, or disconnected at other times, either to disconnect a cylinder of the engine during low speed operation, or disconnected so that the drive rocker arm can be actuated by a low-speed cam. Alternate versions provide more than one free rocker to provide intermediate speeds, as well as low and high. The rocker arms are interconnected by hydraulically actuated coupling pins. There is no teaching in any respect, nor is it inherent in this prior art construction, of using means supplemental to that required for normal operation to enhance the existing torsional impulses of the engine for use as an actuating force or forces.

U.S. Pat. No. 4,794,893 to Masuda et al. shows and describes an engine valve timing mechanism in which a cam can be shifted into and out of operation to control the engine timing or speed of the valve.

U.S. Pat. No. 4,790,271 to Onda shows an automotive engine with a decompression cam that is brought into and out of action to reduce compression.

U.S. Pat. No. 4,771,742 to Nelson et al. relates to an automotive engine camshaft in which selective cams can be angularly rotated relative to others to change the engine timing. There is no teaching adding cams to enhance the engine torsional pulses, positive or negative.

U.S. Pat. No. 4,754,727 to Hampton merely teaches the use of applying a braking or retarding torque to a camshaft for angularly displacing the camshaft relative the engine crankshaft to change engine timing.

U.S. Pat. No. 4,723,517 to Frost describes a mechanism for applying an oscillating force to a cam as it is being driven to vary engine timing.

U.S. Pat. No. 4,917,056 and U.S. Pat. No. 4,934,348, both to Yagi et al., describe valve timing mechanisms, including a selectively operable, resilient phase control or valve Opening means between the cam and valve for generating a resilient, repulsive force in the valve opening direction or a holding force in the valve closing position to advance or retard the timing. This is a mere selectively operable phase control device, per se, not a means fixed as an integral part of the mechanism to provide enhanced torsional impulses at all times, positive or negative, as the case may be.

U.S. Pat. No. 3,314,408 to Fenton describes a centrifugally operated cam movable into a compression released position to open a particular valve when the engine speed is below a preset level.

SUMMARY OF THE INVENTION

The invention is directed to several concepts/methods and apparatuses for enhancing the natural bidirectional torsional pulses in the valve train, albeit negative or positive, produced during operation of the engine, for use as actuating forces in, for example, self-energizing phaseshifters to permit advancing or retarding the valve timing. More particularly, the invention relates to several methods for supplementing or selectively utilizing torque pulsations to cause self-energizing phaseshifter concepts to be feasible: for example, 1) by the use of additional cam-lobes spring pairs; 2) by selectively increased loads for the valve train springs; and 3) by the use of coaxial camshafts with independent phaseshifter mechanisms.

Each of the first two methods described provide supplemental torque pulses in the directions desired to compensate for the lower than desired torque pulses naturally produced during the engine operation.

It is, therefore, a primary object of the invention to provide a method/apparatus for enhancing the natural bidirectional torsional pulses inherently produced in an engine during its operation, for use as self-energizing actuating forces, for example, in a valve timing phaseshifter.

It is a further object of the invention to enhance the torsional pulses described above in a number of ways such as, for example, by providing additional cam-lobe spring pairs to create additional or supplemental, bidirectional pulses, as desired; or by selectively increasing the spring loads, or providing additional springs, to produce supplemental torque pulses, or by dividing or separating the camshaft into a number of parts, with the separate parts driving the different parts of the valve train to provide supplemental, or isolated, torque pulses in the manner desired to produce the desired bidirectional torsional pulses.

Other objects, features, and advantages of the invention will become more apparent upon reference to the succeeding, detailed description thereof, and to the drawings illustrating the preferred embodiments thereof.

DESCRIPTION OF THE PREFERRED EMBODIMENTS

Figure 1A:
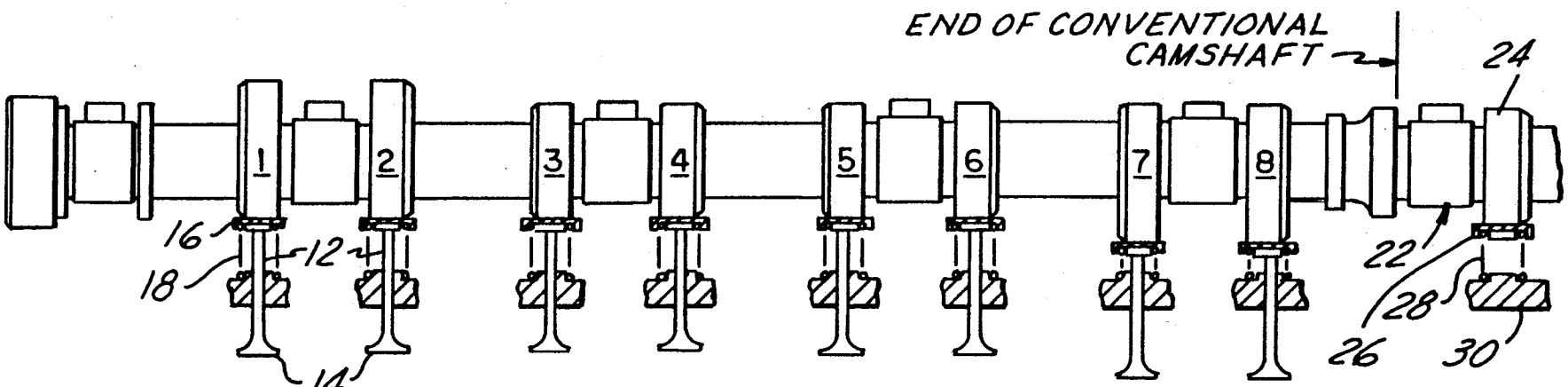
FIG. 1A is a side elevational view, with parts thereof in cross-section, illustrating a first embodiment of the invention.

As stated previously, the invention is directed to several concepts/methods and apparatuses for supplementing the inherent natural bidirectional torsional pulses generated by the engine during its operation, for use as an activating force for other purposes. One such method/apparatus is illustrated in FIG. 1A. It shows in side elevation an essentially conventional automotive type engine camshaft 10 having eight cams indicated thereon. Each is engageable with the stem 12 of a valve 14 through the intermediary of a rocker arm 16 and a valve return spring 18. In this particular case, the bidirectional torsional impulses produced by the compression and decompression of the springs may cancel one another out or reduce the torsional pulse in one direction or the other so that there is a large differential between the two.

Figure 1B:
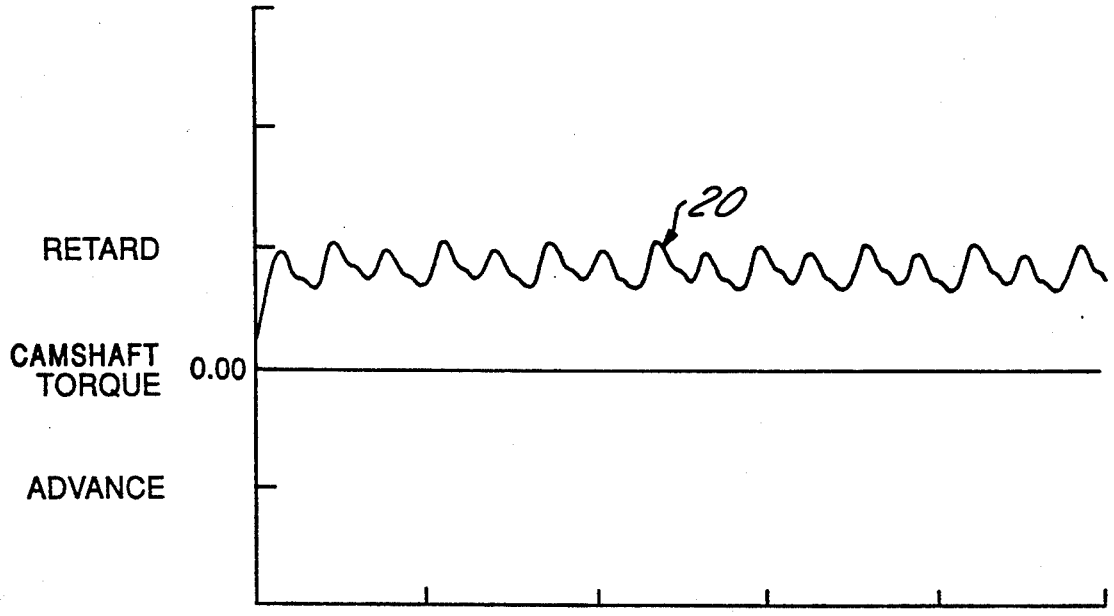
FIGS. 1B and 1C illustrate graphically, first in FIG. 1B, the bidirectional torsional pulses produced by a commercially available engine, and, secondly in FIG. 1C, the same engine embodying the concept/apparatus of the invention.

Such case is illustrated graphically in FIG. 1B where the actual torsional pulses indicated by the curve 20 of a commercially available engine, for example, are unbalanced. That is, the graph shows that the torque impulses are all to one side of zero level, which is the indicator of a balance between positive and negative torque impulses. In this particular case, the camshaft is resisting the rotation of the crankshaft resulting in an engine timing retard situation. This, therefore, would not be suitable for use with a self-energizing phaseshifter, as the retarding and advancing torque impulses in that case would need to be balanced.

Returning to FIG. 1A, as will be seen, the camshaft is shown with a short extension 22 on which is mounted at least one additional or further cam 24. The cam is engageable with a valve train unit consisting of a rocker arm 26, a return spring 28, and a spring seat 30. In this case, an additional valve is unnecessary for providing the supplemental torque pulse desired.

The additional cam-lobe spring pair will create additional torque pulses that would be phased appropriately to enhance in this case the advancing pulses to compensate for that not indicated in FIG. 1A; that is, the introduction of the additional cam-lobe spring pair would generate additional torque pulses to create net torque reversals for the entire camshaft if the magnitude of the extra torque pulses are sufficient to provide the desired positive or negative pulse supplement and timings of the extra events are properly placed.

Figure 1C:
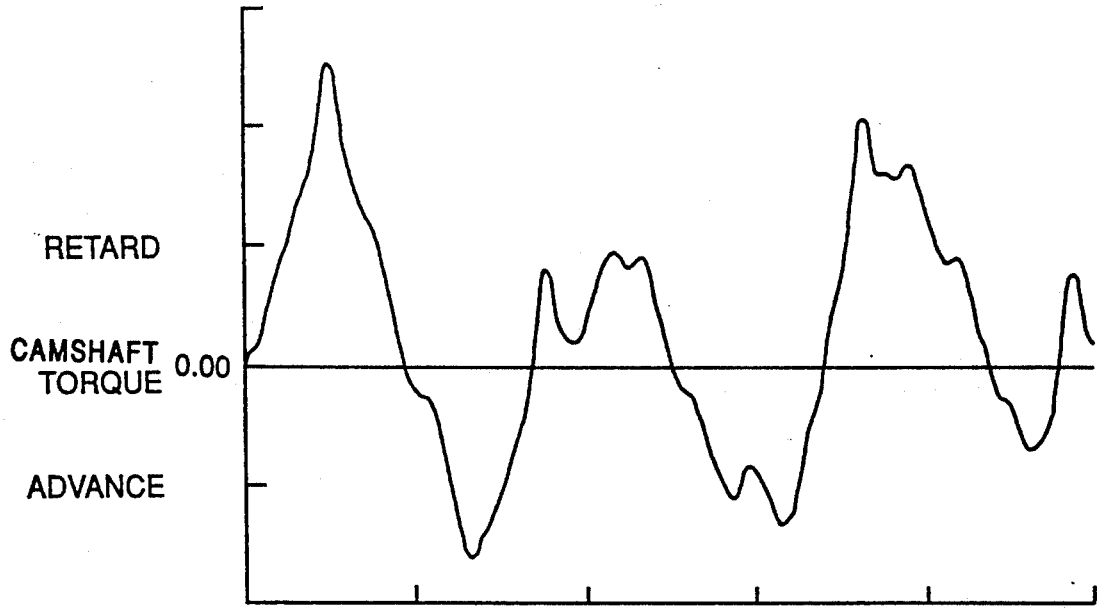

While only one additional cam-lobe spring unit is shown, it will be clear that more could be used without departing from the scope of the invention to provide whatever additional or supplemental torque pulses are required. For example, if three additional torque events were desired, three individual cam lobes could act on three additional inertia spring members. An example of the result of adding additional cam spring members is illustrated in FIG. 1C showing a balance of positive and negative pulses on opposite sides of the zero or balance line, for the same engine illustrated in FIG. 1B.

Other methods of providing the additional torque pulses could be by locating the extra cam spring pairs on a balance shaft connected to the camshaft, or alternatively, the extra cam spring pairs could be an integral part of the phaseshifter mechanism. If three individual cam lobes acting on three extra inertia spring members proved to be costly, a three event cam lobe could act on one inertia spring member. On a V-8 engine, for example, the three extra cam lobes could be at the same timings as the three cam lobes on one bank of the V-8 engine, which would be responsible for the majority or torque reversals.

Figure 2:
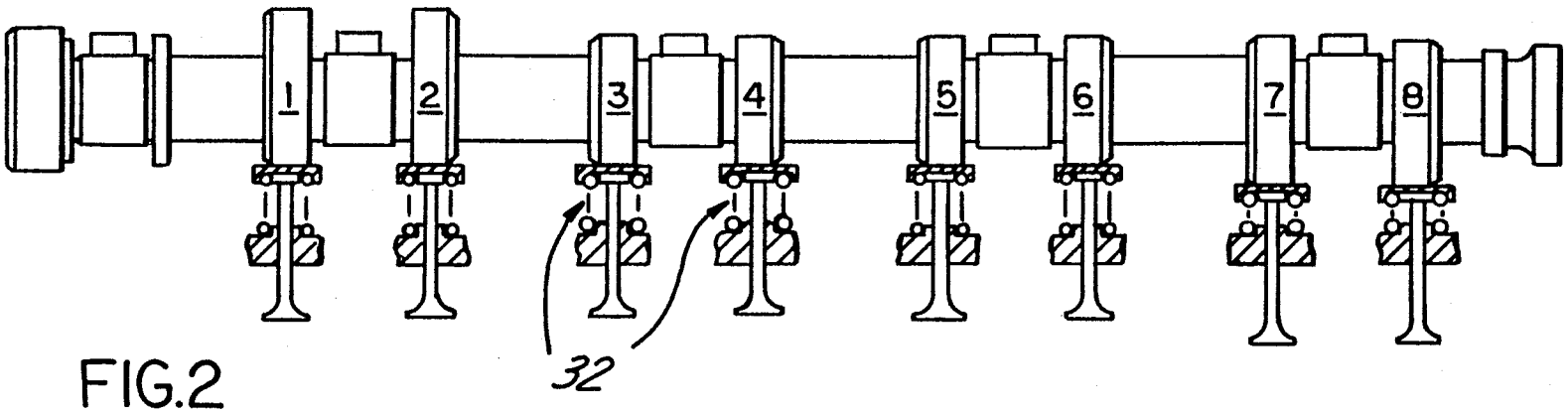
FIG. 2 is a side elevational view, with parts in cross-section, illustrating a second embodiment of the invention.

A second concept/method of increasing or supplementing the natural torsional pulses would be as illustrated in FIG. 2 by utilizing selective valve spring stiffness differences. More particularly, FIG. 2 shows the camshaft 10, again with cams 1–8, operating on individual cam-spring pairs. In this case, the load of a portion of the valve train springs has been changed in a selective manner to provide for a difference in magnitude of the selected torque pulses from individual cam-spring pairs, which when combined produce net torque reversals in the desired amount.

This is accomplished in FIG. 2 by increasing the spring stiffness of selected engine valve springs beyond the levels required for maximum speed operation of the valve train at high speeds without toss. For example, the return springs for the valve trains associated with cams 1, 2, and 5, 6 could be conventional. However, the return springs 32 associated with the cams 3, 4 and 7, 8 are shown as having a larger wire diameter and fewer coils, making the springs stiffer and thereby increasing the magnitude of every other bidirectional torque pulse changing the weight of selective ones of the springs would be another approach. All of these changes, of course would be Phased appropriately to enhance either retarding or advancing pulses, as desired. Although this approach may result in increased friction, usage on selected valves with roller valve trains could minimize these incremental losses.

Further examples of how this concept could be applied would be to use lightweight valve train components, such as hollow valves, to reduce overall density; beehive-shaped springs; reduced diameter valve retainers, but, however, on a selected minimum group of lightweight valves; or by increasing the load by the use of conventional valve springs to produce individual torque reversals of greater magnitude than those of the remaining lightweight cam-spring pairs which use light spring loads. Providing the proper values are selected whose cam timings result in enhancement versus cancellation of torque reversals, the desired torque reversals could be created for the complete camshaft to allow the self-energizing phaseshifter concept to operate properly.

Figure 3A:
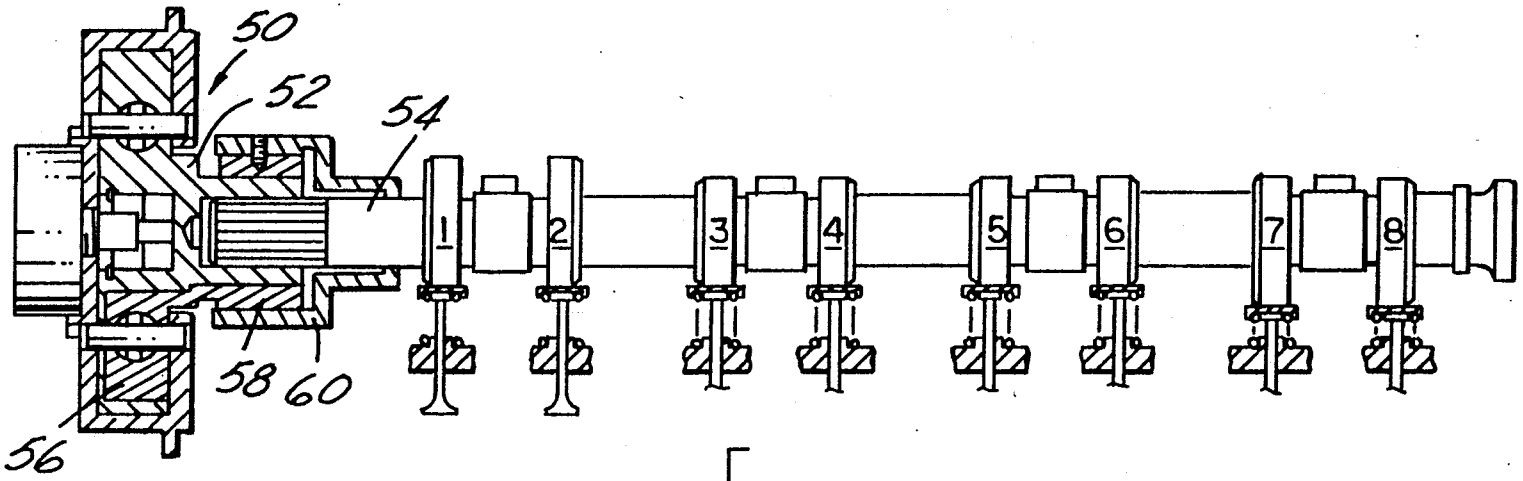
FIG. 3A is a side elevational view, with parts in cross-section, illustrating a third embodiment of the invention.

FIG. 3A illustrates a further embodiment of the invention. In this case, the conventional simple camshaft has been split into two coaxial camshafts. The two are independently driven by independently acting self-energizing phaseshifter elements contained in one or separate housings, as the case may be. In this case, the individual intake and exhaust valve cam lobes would be selected appropriately with timings that result in net bidirectional torque pulses for the individual coaxial camshafts.

In other words, the cams, which normally individually provide both retard and advance pulses but as a group tend to have pulses cancelled, are separated to restore the advancing torque pulses to be driven by one of the coaxial shafts, the remaining of the cams being driven by the other coaxial shaft. This would contrast with the cam lobe arrangement of FIG. 1B wherein all of the cams on the single camshaft resulted in cancellation of bidirectional torque pulses from the single lobes.

Figure 3B:
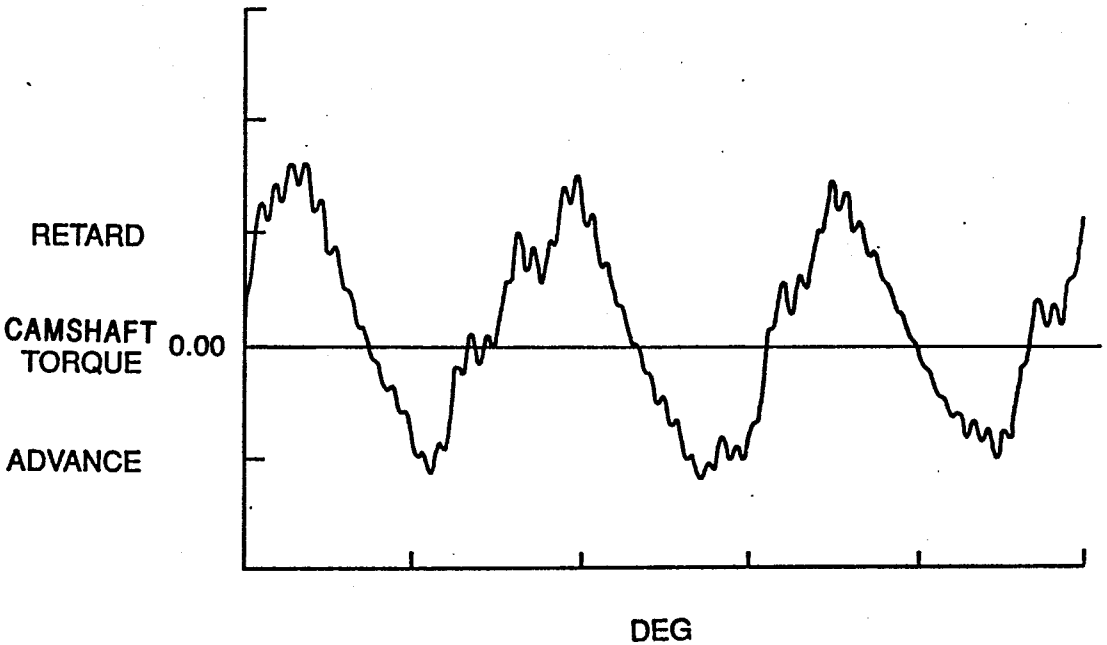
FIG. 3B illustrates graphically the results of the operation of the engine in which the concepts/apparatus of the invention are embodied.

This particular FIG. 3A embodiment could be applied through the use of two separate phaseshifter mechanisms; or, alternatively, a dual phaseshifter with two independent phaseshifter elements per housing to directly control the phasing of the coaxial camshafts. For example, on V-8 or V-6 cam-in-block engines, one of the coaxial camshafts could control one bank of valves and the other member could control the other bank and move simultaneously. The results of such a construction are illustrated graphically in FIG. 3B showing the essentially equal bidirectional torque pulses extending to opposite sides of the zero line. Contrast this with the unequal retarding torque pulse curve 20 shown in FIG. 1B.

FIG. 3A shows a coaxial camshaft coupled to a self-energizing phaseshifter indicated in general at 50. More particularly, the phaseshifter has an inner shaft phaser 52 splined to the inner shaft 54, as indicated. It also has an outer shaft phaser 56 that is splined as shown at 58 to the outer shaft 60. In this case, although the actual connection is not shown, the rotation of cams 3, 4 and 7, 8 could be controlled by the inner shaft 54, while the cams 1, 2 and 5, 6 could be controlled by the outer shaft 60.

Of course, the selection of the cams and cam-spring combinations to be controlled by either shaft would be such as to enhance the torsional impulses to the degree desired to provide the desired effect for any particular engine. The phaseshifter per se, being split by the use of coaxial shafts, would respond to the positive and negative torque impulses to be self-energizing to vary the engine timing in the scheduled manner. The details of construction and operation of the phaseshifter per se, are not given since they are believed to be unnecessary for an understanding of the invention. While the use of only two coaxial shafts has been described, it will be clear that the single camshaft could be split into any number of coaxial shafts, as the need arose to meet the particular torsional pulse requirements.

Figure 4A:
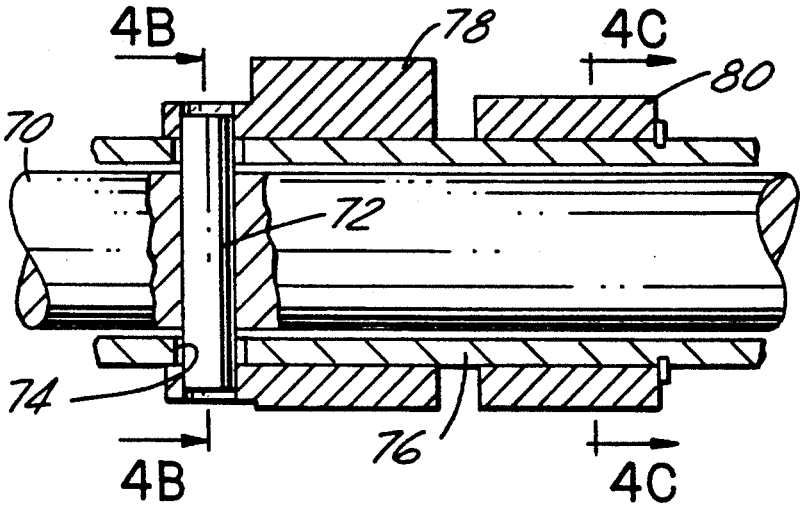
FIG. 4A is a cross-sectional view of an embodiment of the invention similar to that shown in FIG. 3A.
Figure 4B:
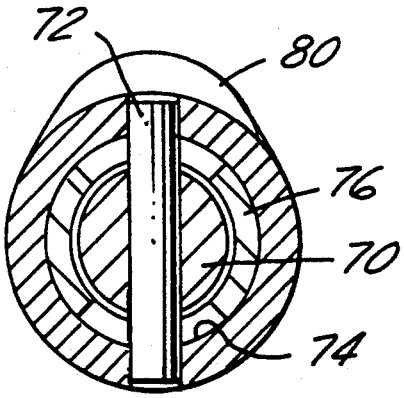
FIGS. 4B and 4C are cross-sectional views taken on planes indicated and viewed in the direction of the arrows 4B—4B and 4C—4C of FIG. 4A.
Figure 4C:
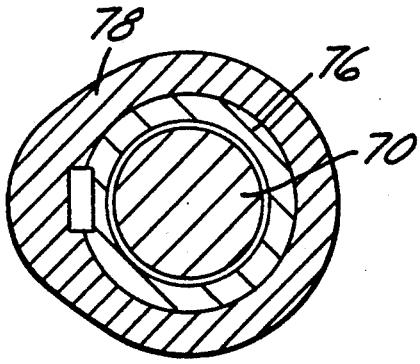

FIGS. 4A, 4B, and 4C illustrate one method of attaching the individual cams to the coaxial camshafts. More particularly, an inner shaft 70 could be connected by a cross pin 72 through an opening 74 in an outer sleeve shaft 76 to a number of cam elements 78 (only one shown) for driving the same. On the other hand, the outer shaft 76 could have attached thereto a number of cams 80 (only one shown) for actuation by the outer shaft.

From the foregoing, therefore, it can be seen that the invention provides a number of concepts/methods and apparatuses for enhancing the natural bidirectional torsional impulses produced by an engine in operation to produce a balanced set of forces usable, for example, in engine self-energizing phaseshifters. It will be clear, however, that it will have many other uses wherever an engine valve train produces net torsional pulses that are unbalanced.

It will also be seen that the invention provides the capability of applying a self-energizing phaseshifter mechanism to any engine regardless of the number of cylinders, valve train type, or firing order, by creating bidirectional torque pulses that allow advancing or retarding the camshaft, in contrast to those engines in which the torsional pulses are inadequate or balance one another to a point where advancing the camshaft is not possible by the use of a self-energizing phaseshifter mechanism.

While the invention has been shown and described in its preferred embodiments, it will be clear to those skilled in the arts to which it pertains that many changes and modifications may be made thereto without departing from the scope of the invention.

We claim:

1. A torsional pulse enhancer in an automotive type engine having inherent bidirectional positive and negative torsional pulses in an engine valve train resulting from a drive of an engine camshaft by a crankshaft, the enhancer including:

supplemental means to selectively increase at least one of the positive and negative torque pulses for use as self-actuating torque reversing forces to vary valve timing events, wherein the supplemental means reinforces at least one of a retarding and an advancing torque pulses sufficiently to enhance and avoid cancellation of the retarding and advancing pulses;

the supplemental means includes varying a stiffness of selective one of plurality of engine valve springs to enhance the torque pulses.

2. A torsional pulses enhancer in an automotive type engine having inherent bidirectional positive and negative torsional pulses in an engine valve train resulting from a drive of an engine camshaft by a crankshaft, the enhancer including:

supplemental means to selectively increase at least one of the positive and negative torque pulses for use as self-actuating torque reversing forces to vary valve timing events, wherein the supplemental means reinforces at least one of a retarding and an advancing torque pulses sufficiently to enhance and avoid cancellation of the retarding and advancing pulses;

the supplemental means includes varying a load of selective one or more of the engine valve train return springs to change the torque pulses resulting from operation thereof.

3. An enhancer as in claim 2, including changing the spring load by changing a weight of selective ones of the valve springs to thereby change the load thereof.

* * * * *